US010190535B2

(12) United States Patent
Lee et al.

(10) Patent No.: US 10,190,535 B2
(45) Date of Patent: Jan. 29, 2019

(54) HYPEREUTECTIC ALUMINUM-SILICON-BASED ALLOY HAVING SUPERIOR ELASTICITY AND WEAR RESISTANCE

(71) Applicant: Hyundai Motor Company, Seoul (KR)

(72) Inventors: Tae-Gyu Lee, Seoul (KR); Jae-Hwang Kim, Gyeonggi-do (KR); Hoon-Mo Park, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 385 days.

(21) Appl. No.: 14/958,132

(22) Filed: Dec. 3, 2015

(65) Prior Publication Data

US 2017/0096961 A1 Apr. 6, 2017

(30) Foreign Application Priority Data

Aug. 13, 2015 (KR) ..... 10-2015-0114284

(51) Int. Cl.
*F02F 7/00* (2006.01)
*C22C 21/02* (2006.01)

(52) U.S. Cl.
CPC ..... *F02F 7/0085* (2013.01); *C22C 21/02* (2013.01); *F02F 2007/009* (2013.01)

(58) Field of Classification Search
CPC ..... C22C 21/02; F02F 2007/009
See application file for complete search history.

(56) References Cited

FOREIGN PATENT DOCUMENTS

| | | | | |
|---|---|---|---|---|
| CN | 103911529 A | | 7/2014 | |
| JP | 06-192780 A | | 7/1994 | |
| JP | 11-336899 A | | 7/1999 | |
| JP | 11-0293374 A | | 10/1999 | |
| JP | 2009-132985 A | | 6/2009 | |
| JP | 2009132985 A | * | 6/2009 | ..... C22C 21/02 |
| KR | 10-0448536 B1 | | 9/2004 | |
| KR | 2006-0130762 A | | 12/2006 | |
| KR | 10-2013-0058997 A | | 6/2013 | |
| KR | 10-1316068 B1 | | 10/2013 | |

* cited by examiner

*Primary Examiner* — George Wyszomierski
*Assistant Examiner* — Janelle Morillo
(74) *Attorney, Agent, or Firm* — Mintz Levin Cohn Ferris Glovsky and Popeo, P.C.; Peter F. Corless

(57) ABSTRACT

Disclosed is an aluminum alloy having superior elasticity and wear resistance. The aluminum alloy has superior elasticity and wear resistance and improved wear properties by including additional reinforcing phase formation such as $Al_3Ni$ phase formation. In particular, the reinforcing phase may be generated by adding nickel (Ni) that may reinforce and enhance properties which may be decreased due to generation of a ternary phase such as TiAlSi. The aluminum alloy comprises an amount of about 13 to 21% by weight of the silicon (Si), an amount of about 1 to 5% by weight of the nickel (Ni), an amount of about 4 to 5% by weight of the titanium (Ti), an amount of about 0.7 to 1% by weight of boron (B), and a remainder of Al based on a total weight of the aluminum alloy.

9 Claims, 8 Drawing Sheets

HYPEREUTECTIC ALUMINUM-SILICON-BASED ALLOY HAVING SUPERIOR ELASTICITY AND WEAR RESISTANCE

CROSS-REFERENCE TO RELATED APPLICATION

This application claims the priority benefit of Korean Patent Application No. 10-2015-0114284, filed on Aug. 13, 2015 in the Korean Intellectual Property Office, the disclosure of which is incorporated herein by reference.

TECHNICAL FIELD

The present invention relates to a hypereutectic Al—Si-based alloy having superior elasticity and wear resistance. The hypereutectic Al—Si based alloy may include titanium (Ti), boron (B), nickel (Ni), and the like and further include TiAlSi phase and the like that is generated by adding a primary Si phase into $Al_3Ti$, thereby overcoming property deterioration.

BACKGROUND

Recently, many countries including developed countries have been trying to control environmental pollution by strengthening various environmental regulations. In the vehicle industry, researches for improving fuel efficiency have been conducted through weight reduction and the like to satisfy such increasing environmental regulations. Accordingly, weight reduction and high torque requirements for vehicles have been increasingly strengthened.

In order to meet such requirements, researches into weight reduction through use of an aluminum alloy having about ⅓ the density of a conventional steel material have been conducted, and, for example, hypereutectic Al—Si based alloys and the like have been developed.

Hypereutectic Al—Si based alloys also can have superior wear resistance, satisfactory corrosion resistance and a low coefficient of thermal expansion, compared to other Al-based alloys, and thus have been widely used in wear-resistant parts such as a cylinder block or a cylinder block in an internal combustion engine of vehicles.

In general, a hypereutectic Al—Si based alloy includes 16 to 18% by weight of silicon (Si), 0.5% by weight or less of iron (Fe), 4 to 5% by weight of copper (Cu), 0.1% by weight or less of manganese (Mn), 0.45 to 0.65% by weight of magnesium (Mg), 0.1% by weight or less of zinc (Zn), 0.2% by weight of titanium (Ti) and a remainder of aluminum (Al). For instance, in order to secure wear resistance, a certain hypereutectic Al—Si based alloy includes a larger amount of silicon (Si) than that of ADC12-based aluminum alloys. In the related art, an alloy composed of the composition may be referred to as an A390-based aluminum alloy.

As an alloy similar to the A390-based aluminum alloy, an ADC12-based aluminum alloy also has been developed. The ADC12-based aluminum alloy is different from the A390-based aluminum alloy in its compositions, such that the ADC12-based aluminum alloy only includes 9.6 to 12.0% by weight of silicon (Si) unlike the A390-based aluminum alloy. Due to such difference in silicon contents, the ADC120-based aluminum alloy has an elastic modulus of about 71 GPa, however, it may not be suitable for use in vehicle components.

In order to address such problem, technology to enhance elastic modulus and wear resistance of the ADC12-based aluminum alloy using precipitation hardening effects of $Al_3Ti$ formed by adding titanium (Ti) and boron (B) to the ADC12-based aluminum alloy has been developed.

For example, ADC12-5Ti-1B may be formed by adding 5% by weight of titanium (Ti) and 1% by weight of boron (B) to the ADC12-based aluminum alloy and has an elastic modulus of about 89 GPa which is an increase of about 25%, as being compared to when titanium (Ti) and boron (B) are not added.

However, a maximum silicon (Si) content of the ADC12-based aluminum alloy is 12% by weight and thus enhancement in properties by increasing the content of silicon (Si) is limited. Accordingly, an A390-5Ti-1B alloy was prepared by adding 5% by weight of titanium (Ti) and 1% by weight of boron (B), as in the ADC12-based aluminum alloy, to the A390-based aluminum alloy having a higher silicon (Si) content than the ADC12-based aluminum alloy. For instance, the A390-5Ti-1B alloy has an elastic modulus of about 90 GPa.

However, a primary Si phase in the A390-5Ti-1B alloy is introduced to $Al_3Ti$ that is formed through addition of titanium (Ti) and boron (B) and thus a TiAlSi ternary phase is formed, thereby decreasing elasticity effects, etc. of an aluminum alloy.

Accordingly, the present inventors have tried to develop a hypereutectic Al—Si based alloy which may enhance properties such as wear resistance and the like, by adding titanium (Ti), boron (B), nickel (Ni), and the like in an aluminum alloy.

SUMMARY OF THE INVENTION

In preferred aspects, the present invention provides a hypereutectic Al—Si based alloy that can have enhanced elasticity, wear resistance, etc. by generating phases such as $Al_3Ti$ and $Al_3Ni$, because the aluminum may include additional nickel (Ni) other than titanium (Ti) and boron (B).

In one aspect the present invention, provided is a hypereutectic Al—Si based alloy or an aluminum alloy hereinafter with superior elasticity and wear resistance. The aluminum alloy may comprise: an amount of about 13 to 21% by weight of silicon (Si), an amount of about 1 to 5% by weight of nickel (Ni), an amount of about 4 to 5% by weight of titanium (Ti), an amount of about 0.7 to 1% by weight of boron (B), aluminum (Al) constituting the remaining balance of the aluminum alloy. Unless otherwise indicated, the % by weight is understood to be based on the total weight of the aluminum alloy composition.

Preferably, the amount of the titanium (Ti) may be about 4% by weight and the amount of the boron (B) may be about 1% by weight.

In addition, the aluminum composition may further comprise an amount of about 4 to 5% by weight of copper (Cu), an amount of about 0.45 to 0.65% by weight of magnesium (Mg), an amount of about 1.3% by weight or less of iron (Fe), an amount of about 0.1% by weight or less of manganese (Mn) and an amount of about 0.1% by weight or less of zinc (Zn). In particular, the amount of the nickel (Ni) may be an amount of about 2.3 to 5% by weight, or particularly, an amount of about 5% by weight, all the wt % based on the total weight of the aluminum alloy.

Further provided are the aluminum alloys that may consist of, consist essentially of, or essentially consist of the components as described herein. For instance, the aluminum alloy may consist of, consist essentially of, or essentially consist of: an amount of about 13 to 21% by weight of silicon (Si), an amount of about 1 to 5% by weight of nickel (Ni), an amount of about 4 to 5% by weight of titanium (Ti), an amount of about 0.7 to 1% by weight of boron (B), aluminum (Al) constituting the remaining balance of the aluminum alloy, all the % by weight based on the total weight of the aluminum alloy composition.

Still further provided are vehicles that comprise the aluminum alloys as described herein. In particular, vehicle parts such as a cylinder block or a cylinder block in an internal combustion engine of the vehicles may comprise the aluminum alloys as described herein. Other aspects of the invention are disclosed infra.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SYMBOLS

10: LINE SCANNING AREA
100: PORTION 1
110: PORTION 2
120: PORTION 3

DETAILED DESCRIPTION

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Further, it is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

It should be understood that the terms used in the specification and appended claims should not be construed as limited to general and dictionary meanings, but interpreted based on the meanings and concepts corresponding to technical aspects of the present disclosure on the basis of the principle that the inventor is allowed to define terms appropriately for best explanation.

Hereinafter, various exemplary embodiments of the present invention will be described in detail with reference to the accompanying drawings. The present invention relates to a hypereutectic Al—Si-based alloy having superior elasticity and wear resistance.

Figure 1:
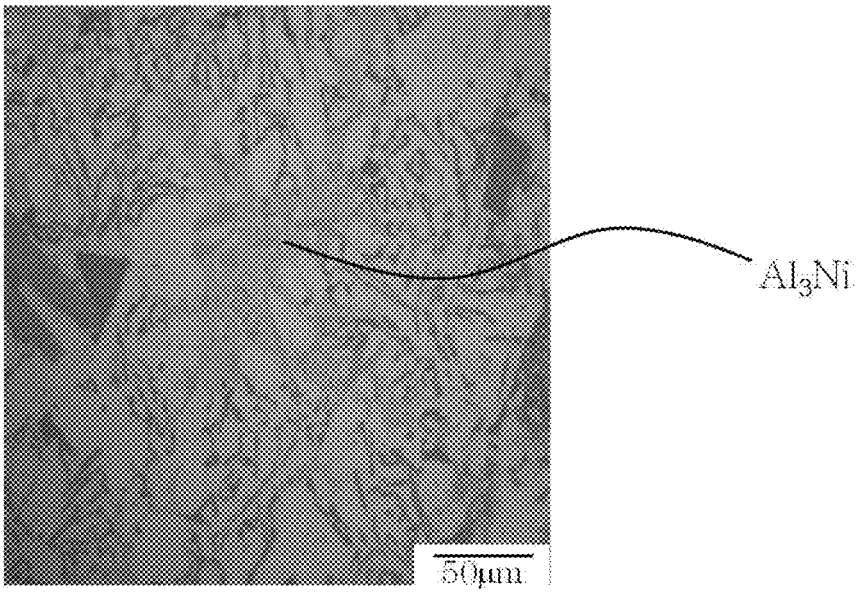
FIG. 1 shows an exemplary phase formation of $Al_3Ni$ in an exemplary hypereutectic Al—Si based alloy.
Figure 2:
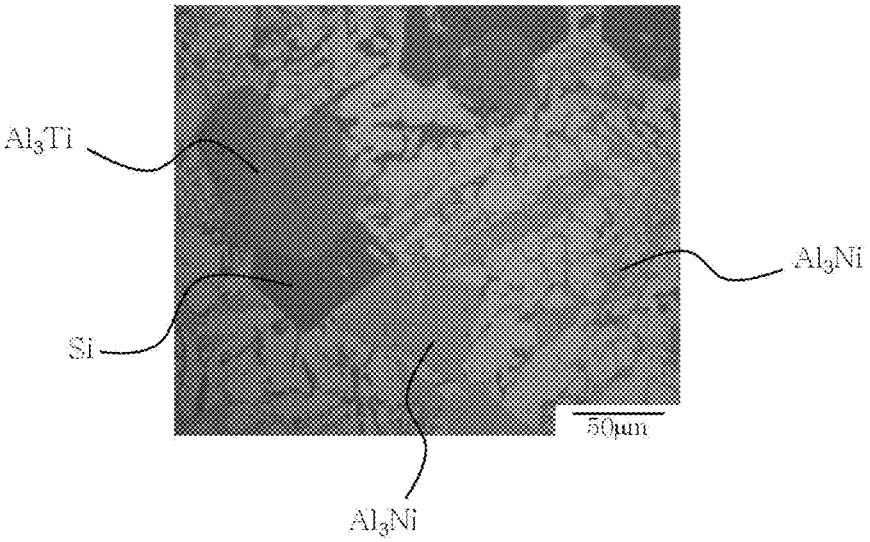
FIG. 2 shows an exemplary phase formation of $Al_3Ni$, $Al_3Ti$, and Si in an exemplary hypereutectic Al—Si based alloy.
Figure 3:
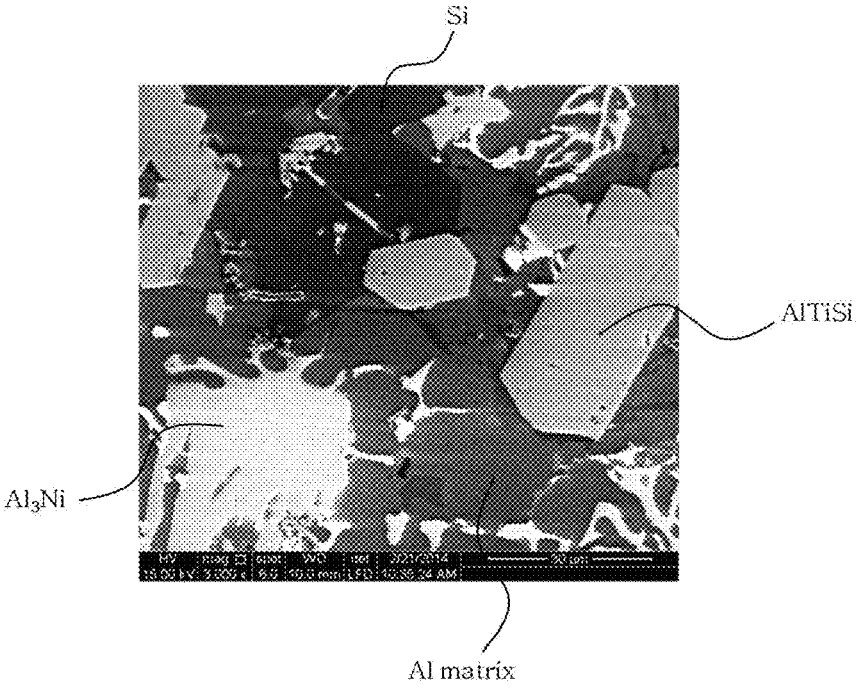
FIG. 3 shows an exemplary phase formation of $Al_3Ni$, AlTiSi, and Si in an exemplary hypereutectic Al—Si based alloy.
Figure 4:
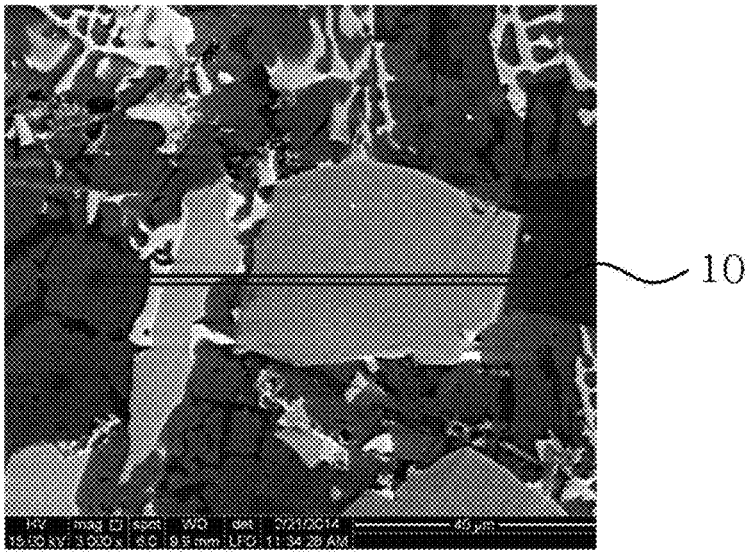
FIG. 4 shows contents of constituents in a line scanning area 10 in an exemplary hypereutectic Al—Si based alloy.
Figure 4:
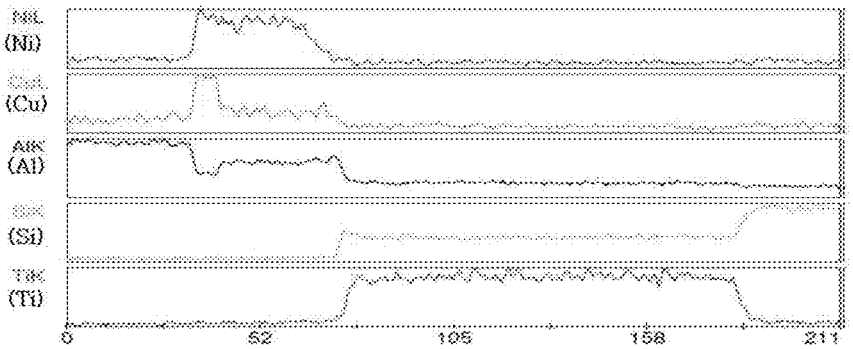

FIGS. 1 to 3 show images illustrating phase formation in a hypereutectic Al—Si based alloy, and FIG. 4 is an image illustrating the contents of constituents in a line scanning area 10. In the present invention, generation of oxide may be delayed by suppressing wear and dispersing stress, frictional heat and the like, through formation of a compound including primary Si and a metal in order to enhance properties such as elasticity and wear resistance of the hypereutectic Al—Si based alloy.

In an exemplary embodiment of the present invention, the hypereutectic Al—Si based alloy or the aluminum alloy may comprise silicon (Si), nickel (Ni), titanium (Ti), boron (B), and a remainder of Al constituting the remaining balance. Preferably, the hypereutectic Al—Si based alloy may comprise an amount of about 13 to 21% by weight of the silicon (Si), an amount of about 1 to 5% by weight of nickel (Ni), an amount of about 4 to 5% by weight of titanium (Ti), and an amount of about 0.7 to 1% by weight of boron (B), all % by weight based on the total weight of the aluminum alloy. Preferably, the content of the nickel (Ni) may be about 2.3 to 5% by weight, or preferably about 5% by weight. In addition, the content of the titanium (Ti) may be about 4% by weight, and the content of the boron (B) may be about 1% by weight.

Preferably, the hypereutectic Al—Si based alloy according to the present invention may further include: an amount of about 4 to 5% by weight of copper (Cu) and an amount of about 0.45 to 0.65% by weight of magnesium (Mg). Alternatively, the hypereutectic Al—Si based alloy may further include an amount of about 1.3% by weight or less of iron (Fe), an amount of about 0.1% by weight or less of manganese (Mn) and an amount of about 0.1% by weight or less of zinc (Zn), and the like in addition to the aluminum alloy composition above that is an amount of about 13 to 21% by weight of the silicon (Si), an amount about 1 to 5% by weight of nickel (Ni), an amount about 4 to 5% by weight of titanium (Ti) and an amount about 0.7 to 1% by weight of boron (B).

Hereinafter, each of the constituents is described in detail.

The silicon (Si), as used herein, may form a primary Si phase and enhance elasticity and wear resistance of an aluminum alloy. However, the silicon (Si) also form TiAlSi as a ternary phase through introduction into $Al_3Ti$ and the like, whereby elasticity effects of aluminum alloy may be decreased and impact resistance may be deteriorated. Therefore, the content of the silicon (Si) may be preferably limited to an amount of about 13 to 21% by weight.

Figure 5:
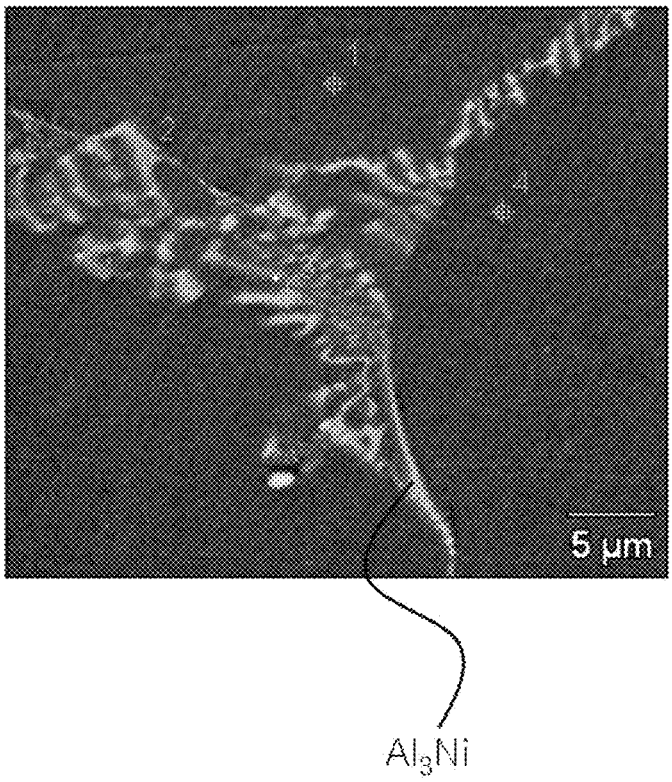
FIG. 5 shows an electron microscope image (micrometer scale) of $Al_3Ni$ phase formation generated in an exemplary hypereutectic Al—Si based alloy.
Figure 6:
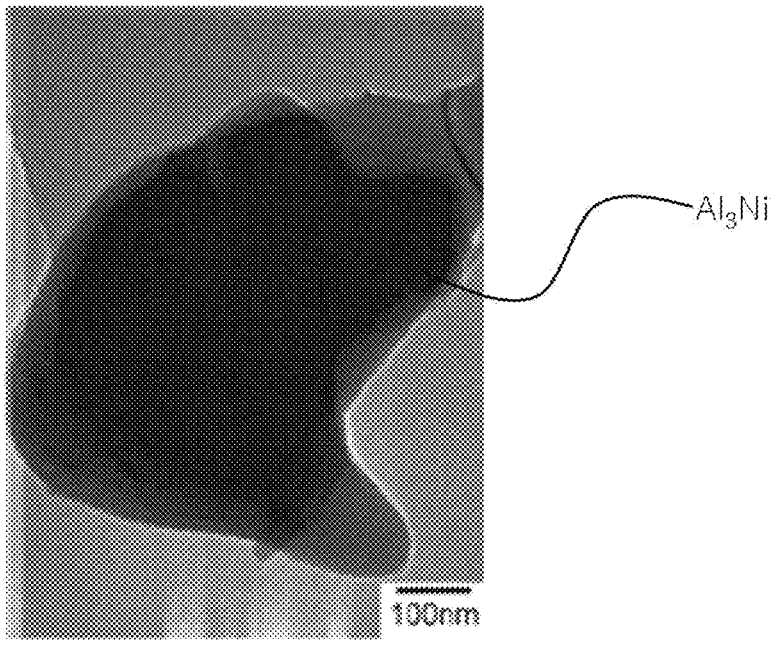
FIG. 6 shows an electron microscope image (nanometer scale) of $Al_3Ni$ phase formation generated in an exemplary hypereutectic Al—Si based alloy.

As illustrated in FIGS. 5 and 6, the nickel (Ni) may improve elastic modulus, wear resistance, and the like of an aluminum alloy through precipitation hardening effects due to an $Al_3Ni$ phase. The $Al_3Ni$ phase may be generated through reaction with aluminum (Al) and have an elastic modulus of about 179 GPa. However, since manufacturing costs may be increased due to use of costly nickel (Ni), and properties such as toughness and elasticity of the aluminum alloy due to formation of compounds having high roughness may be decreased, the content of the nickel (Ni) may be preferably limited to an amount of about 1 to 5% by weight. In particular, the content of the nickel (Ni) may be more preferably in an amount of about 2.3 to 5% by weight, or most preferably an amount of about 5% by weight.

Figure 7:
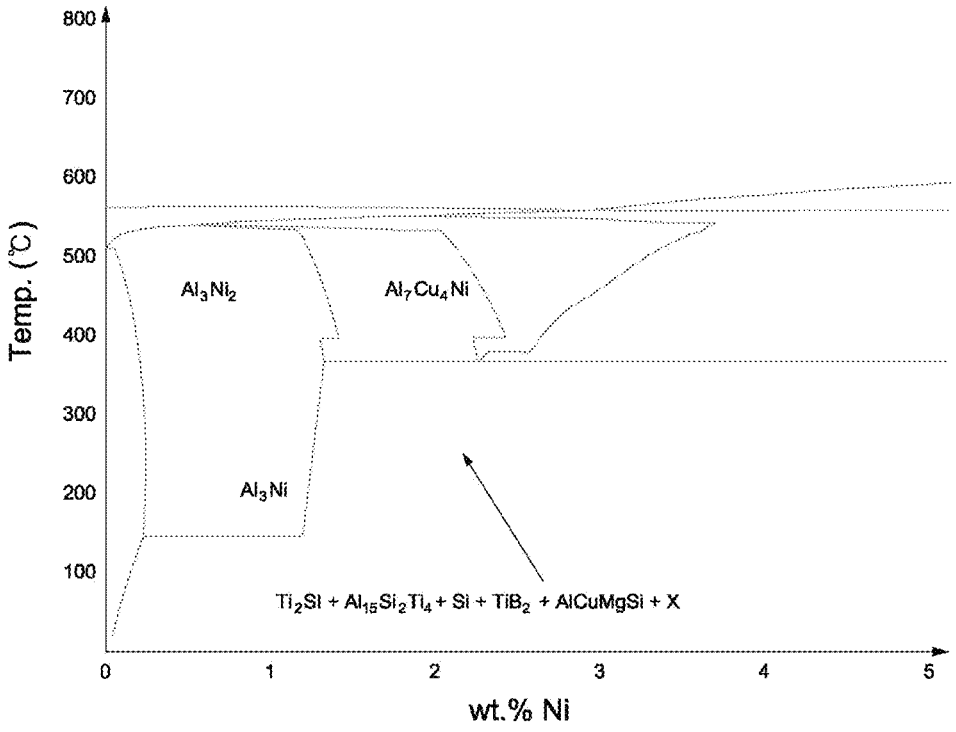
FIG. 7 is a graph illustrating phase formation according to $\chi$ as the content of Ni and temperature in an exemplary A390-4Ti-1B—$\chi$Ni.

FIG. 7 is a view illustrating phase formation according to $\chi$ as the content of Ni and temperature in an exemplary A390-4Ti-1B—$\chi$Ni. Here, when the content of the nickel (Ni) is less than about 2.3% by weight, an $Al_3Ni2$ phase may be generated, and, when the content of the nickel (Ni) is greater than about 2.3% by weight, phases such $Al_3Ni$, Al7Cu4Ni, Al6Ni3Si, and the like may be generated. When the content of the nickel (Ni) is greater than about 5% by weight, the content of the nickel (Ni) may be greater than a total content of about 4% by weight of titanium (Ti) and about 1% by weight of boron (B), and thus, elastic modulus due to titanium (Ti) and boron (B) may be affected. Accordingly, the content of the nickel (Ni) may be preferably limited to an amount of about 5% by weight or less.

The titanium (Ti), as used herein, may improve mechanical properties by refining crystal particles of an aluminum alloy. When the content of Ti is greater than about the predetermined range, mechanical properties may be rather deteriorated. Accordingly, the content of the titanium (Ti) is preferably limited to an amount of about 4 to 5% by weight, or particularly of about 4% by weight.

The boron (B), as used herein, may further improve mechanical properties of an aluminum alloy by fining crystal particles of the aluminum alloy as in the titanium (Ti). However, the boron (B) may form a compound having high roughness and thus properties such as toughness and elasticity of the aluminum alloy may be deteriorated. Accordingly, the content of the boron (B) may be preferably limited to an amount of about 0.7 to 1% by weight, more preferably about 1% by weight.

The copper (Cu), as used herein, may improve \ properties such as wear resistance by reinforcing a matrix of an aluminum alloy, but may decrease properties such as corrosion resistance due to void generation. Accordingly, the content of the copper (Cu) may be preferably limited to an amount of about 4 to 5% by weight.

The magnesium (Mg), as used herein, may improve properties such as wear resistance and strength of an aluminum alloy, but may decrease properties such as toughness and elasticity of the aluminum alloy due to formation of a compound having high roughness. Accordingly, the content of the magnesium (Mg) may be preferably limited to an amount of about 0.45 to 0.65% by weight.

The iron (Fe), as used herein, may be included as a selective or alternative component in the aluminum alloy. The iron (Fe) may be a hard intermetallic compound type, and improve properties such as wear resistance of an aluminum alloy by being minutely, uniformly dispersed in the aluminum alloy. However, since the iron (Fe) may decrease castability and the like and coarsen an intermetallic compound. Accordingly, the content of the iron (Fe) may be preferably limited to an amount of about 1.3% by weight or less.

The manganese (Mn), as used herein, may also be included as a selective or alternative component in the aluminum alloy like the iron (Fe), and may improve properties such as wear resistance of an aluminum alloy by being minutely, uniformly dispersed in the aluminum alloy. However, since the manganese (Mn) may decrease castability and the like, and coarsen an intermetallic compound, the content of the manganese (Mn) may be preferably limited to an amount of about 0.1% by weight or less.

The zinc (Zn), as used herein, may also be included as a selective or alternative component in the aluminum alloy and may improve properties such as corrosion resistance, strength and hardness of an aluminum alloy by refining crystal grains. However, since the zinc (Zn) may decrease properties such as wear resistance, the content of the zinc (Zn) is preferably limited to an amount of about 0.1% by weight.

EXAMPLE

Hereinafter, various exemplary embodiments of the present invention will be described in detail with reference to the accompanying drawings and, as such, may be easily implemented by one of ordinary skill in the art to which the present invention pertains. The present invention may be embodied in many different forms and should not be construed as limited to the embodiments set forth herein.

Hypereutectic Al—Si based alloys according to the present invention were prepared according to constituents and contents of the following Table 1 below, and the elastic moduli, densities, hardnesses and wear areas according to constituents and the contents of aluminum alloys were measured.

TABLE 1

| Classification | Si | Fe | Cu | Mn | Mg | Zn | Ni | Ti | B | Al |
|---|---|---|---|---|---|---|---|---|---|---|
| Comparative Example 1 | 17 | 1.0 | 4 | 0.05 | 0.50 | 0.5 | — | — | — | Remainder |
| Comparative Example 2 | 17 | 1.0 | 4 | 0.05 | 0.50 | 0.5 | 5 | — | — | Remainder |
| Comparative Example 3 | 17 | 1.0 | 4 | 0.05 | 0.50 | 0.5 | — | 4 | 1 | Remainder |
| Comparative Example 4 | 17 | 1.0 | 4 | 0.05 | 0.50 | 0.5 | 5 | 2 | 1 | Remainder |

TABLE 1-continued

| Classification | Si | Fe | Cu | Mn | Mg | Zn | Ni | Ti | B | Al |
|---|---|---|---|---|---|---|---|---|---|---|
| Example 1 | 17 | 1.0 | 4 | 0.05 | 0.50 | 0.5 | 2 | 4 | 1 | Remainder |
| Example 2 | 17 | 1.0 | 4 | 0.05 | 0.50 | 0.5 | 3 | 4 | 1 | Remainder |
| Example 3 | 17 | 1.0 | 4 | 0.05 | 0.50 | 0.5 | 5 | 4 | 1 | Remainder |

Units: % by weight

In Table 1, constituents and contents of Comparative Examples 1 to 4 and Examples 1 to 3 are compared. In order to confirm property differences according to presence or absence and the contents of nickel (Ni), titanium (Ti) and boron (B) in hypereutectic Al—Si based alloys based an A390-based aluminum alloy, the comparative examples and examples in which the constituents and the contents thereof were varied were manufactured.

In detail, in Comparative Example 1, about 17% by weight of silicon (Si), about 1.0% by weight of iron (Fe), about 4% by weight of copper (Cu), about 0.05% by weight of manganese (Mn), about 0.50% by weight of magnesium (Mg), and the like were included. In Comparative Example 2, to realize precipitation hardening effects of $Al_3Ni$, the constituents and contents as in Comparative Example 1 were used and about 5% by weight of nickel (Ni) was further included. In Comparative Example 3, to realize $Al_3Ti$ precipitation hardening effects, the constituents and contents as in Comparative Example 1 were used, and about 4% by weight of titanium (Ti) and about 1% by weight of boron (B) were further included. In Comparative Example 4, to realize precipitation hardening effects of $Al_3Ni$ and $Al_3Ti$, the constituents and contents as in Comparative Example 1 were included, and about 5% by weight of nickel (Ni), about 2% by weight of titanium (Ti) and about 1% by weight of boron (B) were further included.

On the other hand, in Example 1, to realize precipitation hardening effects of $Al_3Ni$ due to nickel (Ni) and precipitation hardening effects of $Al_3Ti$ due to titanium (Ti) and boron (B), the constituents and contents as in Comparative Example 1 were included, and about 2% by weight of nickel (Ni), about 4% by weight of titanium (Ti) and about 1% by weight of boron (B) were further included.

In addition, in Example 2, to realize precipitation hardening effects of $Al_3Ni$ due to nickel (Ni) and precipitation hardening effects of $Al_3Ti$ due to titanium (Ti) and boron (B), constituents and contents as in Comparative Example 1 were included, and about 3% by weight of nickel (Ni), about 4% by weight of titanium (Ti) and about 1% by weight of boron (B) were further included. Constituents and contents thereof in Example 3 were the same as those in Example 2, except that the content of nickel (Ni) was 5% by weight.

TABLE 2

| Classification | Elastic modulus (GPa)/density ($g/cm^3$) | Hardness (HRR) | Wear area ($\mu m^2$) |
|---|---|---|---|
| Comparative Example 1 | 84.0/2.72 | 92.88 | 10104.1 |
| Comparative Example 2 | 91.3/2.80 | 104.54 | 10149.2 |
| Comparative Example 3 | 89.1/2.77 | 105.81 | 8737.8 |
| Comparative Example 4 | 98.13/2.84 | 105.21 | 9523.4 |
| Example 1 | 94.84/2.84 | 106.75 | 7552.4 |
| Example 2 | 97.54/2.86 | 107.82 | 5785.3 |
| Example 3 | 98.9/2.88 | 109.57 | 5490.3 |

In Table 2, the elastic moduli, densities, hardnesses and wear areas of alloys with a weight of about 1 kg having the constituents and contents of Comparative Examples 1 to 4 and Examples 1 to 3 according to Table 1 are compared.

As of Comparative Example 1, since precipitation hardening effects of $Al_3Ni$ and $Al_3Ti$ were not exhibited, decreased elastic modulus and hardness were exhibited, as being compared to Comparative Example 2 having precipitation hardening effects of $Al_3Ni$. In addition, in Comparative Example 3, precipitation hardening effects of $Al_3Ti$ were exhibited and thus higher elastic modulus and hardness were exhibited as being compared to Comparative Example 1. However, in Comparative Example 4, since nickel (Ni), titanium (Ti) and boron (B) for realizing precipitation hardening effects of $Al_3Ni$ and $Al_3Ti$ were included but the content of the titanium (Ti) was low, precipitation hardening effects of $Al_3Ti$ were low and thus a wear area was increased, as being compared to Comparative Example 3.

Meanwhile, in Examples 1 to 3 having precipitation hardening effects of $Al_3Ti$ and precipitation hardening effects of $Al_3Ni$, elastic moduli and hardness were superior and wear areas were small, as being compared to Comparative Examples 1 to 4.

Particularly, in Example 1, the content of nickel (Ni) was decreased, as being compared to the Comparative Example 4, but the content of titanium (Ti) was increased, whereby a wear area was rapidly decreased and hardness was increased. Accordingly, it can be confirmed that, in Example 1, hardness and wear resistance were increased, compared to Comparative Example 4.

In addition, in Examples 1 to 3, the contents of nickel (Ni) were respectively increased by 2, 3 and 5% by weight, and, with increasing nickel (Ni) content, hardness was enhanced and wear areas were decreased. Accordingly, it can be confirmed that the content of the nickel (Ni) may be preferably of about 1 to 5% by weight, more preferably of about 2.3 to 5% by weight, most preferably of about 5% by weight.

Figure 8:
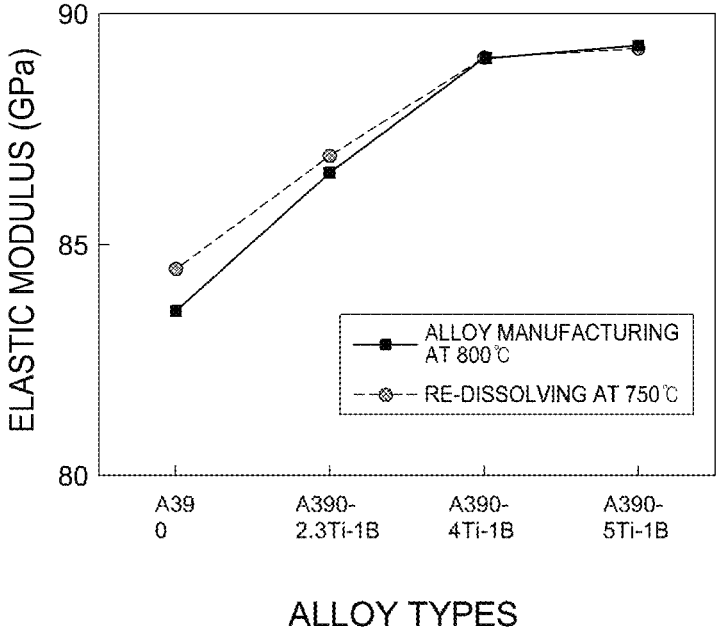
FIG. 8 is a graph illustrating change in elastic moduli according to the content of titanium (Ti) in an exemplary aluminum alloy prepared at a temperature of about 800° C. and a casting manufactured after re-dissolving an ingot at a temperature of about 750° C., according to an exemplary embodiment of the present invention.

Meanwhile, FIG. 8 is a graph illustrating elastic modulus changes according to change in titanium (Ti) contents of an alloy manufactured at a temperature of about 800° C. and a casting manufactured after redissolving ingot at a temperature of about 750° C.

Thus, it can be confirmed that an elastic modulus of an A390-based aluminum alloy including about 17% by weight of silicon (Si), about 1.0% by weight of iron (Fe), about 4% by weight of copper (Cu), about 0.05% by weight of manganese (Mn), about 0.50% by weight of magnesium (Mg), about 0.5% by weight of zinc (Zn), and the like was less than about 85 GPa, and an A390-based aluminum alloy further including about 2.3% by weight of titanium (Ti) and about 1% by weight of boron (B) exhibited an increased elastic modulus due to precipitation hardening effects of $Al_3Ti$, etc.

However, when an A390-based aluminum alloy included about 4% by weight of titanium (Ti) and about 1% by weight of boron (B), and included about 5% by weight of titanium (Ti) and about 1% by weight of boron (B), an elastic modulus was highest. Therebetween, it can be confirmed that, when about 4% by weight of titanium (Ti), which is expensive, is used, an elastic modulus with respect to manufacturing costs may be satisfactory, as being compared to the case in which about 5% by weight of titanium (Ti) is used.

Figure 9:
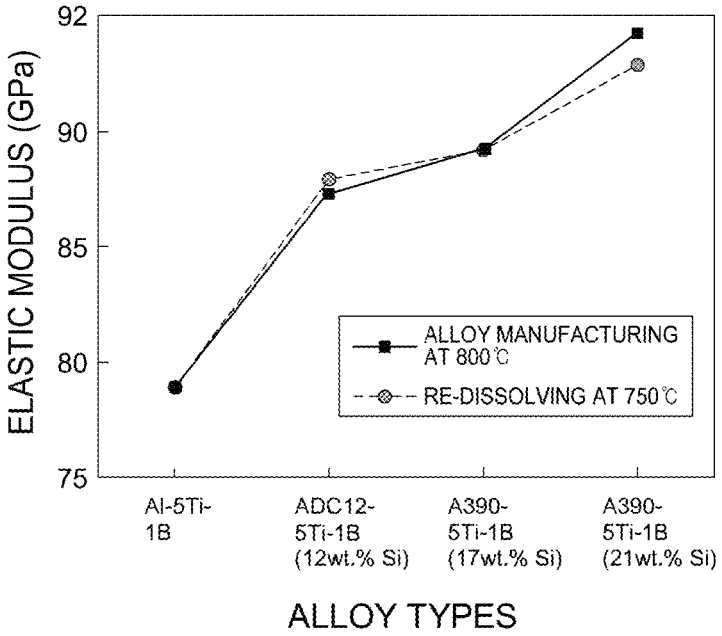
FIG. 9 is a graph illustrating change in elastic moduli according to the content of silicon (Si) in an exemplary aluminum alloy prepared at a temperature of about 800° C. and a casting manufactured after redissolving ingot at about a temperature of 750° C. according to an exemplary embodiment of the present invention.

In addition, FIG. 9 is a graph illustrating an alloy manufactured at about a temperature 800° C. and elastic modulus changes according to silicon (Si) content of a casting manufactured after re-dissolving an ingot at a temperature about 750° C. More particularly, about 1.0% by weight of iron (Fe), the elastic modulus of an aluminum alloy including about 4% by weight of copper (Cu), about 0.05% by weight of manganese (Mn), about 0.50% by weight of magnesium (Mg), about 0.5% by weight of zinc (Zn), and the like was about 80 GPa, but the elastic modulus of an ADC12-based aluminum alloy wherein about 12% by weight of silicon (Si) was further added to the aluminum alloy was rapidly increased due to primary Si.

In addition, it can be confirmed that the elastic modulus of an A390-based aluminum further including about 17% by weight of silicon (Si) in addition to the aluminum alloy including about 1.0% by weight of iron (Fe), about 4% by weight of copper (Cu), about 0.05% by weight of manganese (Mn), about 0.50% by weight of magnesium (Mg), about 0.5% by weight of zinc (Zn), and the like was higher than that of an ADC12-based aluminum alloy further including about 12% by weight of silicon (Si).

Further, it was confirmed through experimental results that, when the content of silicon (Si) was increased by about 21% by weight, an elastic modulus was close to about 95 Pa. Accordingly, it can be confirmed that, in order to obtain an effective elastic modulus, the content of silicon (Si) may be preferably limited to about 13% to 21% by weight.

TABLE 3

| Classification | Elastic modulus (GPa) | Note |
|---|---|---|
| Comparative Example 5 | 97.45 | A390-1Ti—1B—5Ni |
| Comparative Example 4 | 98.13 | A390-2Ti—1B—5Ni |
| Comparative Example 6 | 100.54 | A390-3Ti—1B—5Ni |
| Example 3 | 103.25 | A390-4Ti—1B—5Ni |
| Example 4 | 105.94 | A390-5Ti—1B—5Ni |
| Comparative Example 7 | 108.71 | A390-6Ti—1B—5Ni |

In Table 3, elastic moduli of alloys with a weight of about 25 kg including an A390-based aluminum alloy including about 1.0% by weight of iron (Fe), about 4% by weight of copper (Cu), about 0.05% by weight of manganese (Mn), about 0.50% by weight of magnesium (Mg), about 0.5% by weight of zinc (Zn), about 17% by weight of silicon (Si), and the like and additionally 1% by weight of boron (B) and 5% by weight of nickel (Ni), and respectively 1, 2, 3, 4, 5 and 6% by weight of titanium (Ti) according to Comparative Examples and Examples are compared.

In Table 3, Examples 3 and 4, in which the contents of titanium (Ti) were respectively 4 and 5% by weight, exhibit a high elastic modulus increase ratio, as being compared to the comparative examples. Accordingly, it can be confirmed that the content of the titanium (Ti) may be preferably 4 to 5% by weight.

However, when the content of titanium (Ti) is excessively high as in Comparative Example 7, manufacturing costs may be rapidly increased. Accordingly, the content of the titanium (Ti) may be preferably less than 6% by weight.

TABLE 4

| Classification | Elastic modulus (GPa) | Note |
|---|---|---|
| Example 5 | 93.13 | A390-4Ti—1B—1Ni |
| Example 1 | 94.84 | A390-4Ti—1B—2Ni |
| Example 2 | 97.54 | A390-4Ti—1B—3Ni |
| Example 6 | 100.37 | A390-4Ti—1B—4Ni |
| Example 3 | 103.25 | A390-4Ti—1B—5Ni |

In Table 4, the elastic moduli of the examples that include the A390-based aluminum alloy including about 1.0% by weight of iron (Fe), about 4% by weight of copper (Cu), about 0.05% by weight of manganese (Mn), about 0.50% by weight of magnesium (Mg), about 0.5% by weight of zinc (Zn), about 17% by weight of silicon (Si), etc., and additionally 4% by weight of titanium (Ti) and 1% by weight of boron (B), and respectively 1, 2, 3, 4 and 5% by weight of nickel (Ni) are compared.

As shown in Table 4, an elastic modulus increase ratio in Example 2 in which the content of nickel (Ni) was 3% by weight was higher than that in Example 1 in which the content of nickel (Ni) was 2% by weight. In particular, an elastic modulus in Example 3 in which the content of nickel (Ni) was 5% by weight was highest. Accordingly, it can be confirmed that the content of nickel (Ni) may be preferably 1 to 5% by weight, more preferably 2.3 to 5% by weight, most preferably 5% by weight.

TABLE 5

| | | Classification | |
|---|---|---|---|
| | | Comparative Example 3 Elastic modulus (GPa)/density ($g/cm^3$) | Example 1 Elastic modulus (GPa)/density ($g/cm^3$) |
| Alloy having weight of about 25 kg | | 89.5/2.77 | 95.3/2.82 |
| Alloy having weight of about 300 kg | Part 1 (100) | 91.6/2.78 | 95.4/2.83 |
| | Part 2 (110) | 92.7/2.79 | 95.1/2.83 |
| | Part 3 (120) | 95.7/2.82 | 97.7/2.84 |
| Average | | 93.3/2.80 | 96.1/2.84 |

Figure 10:
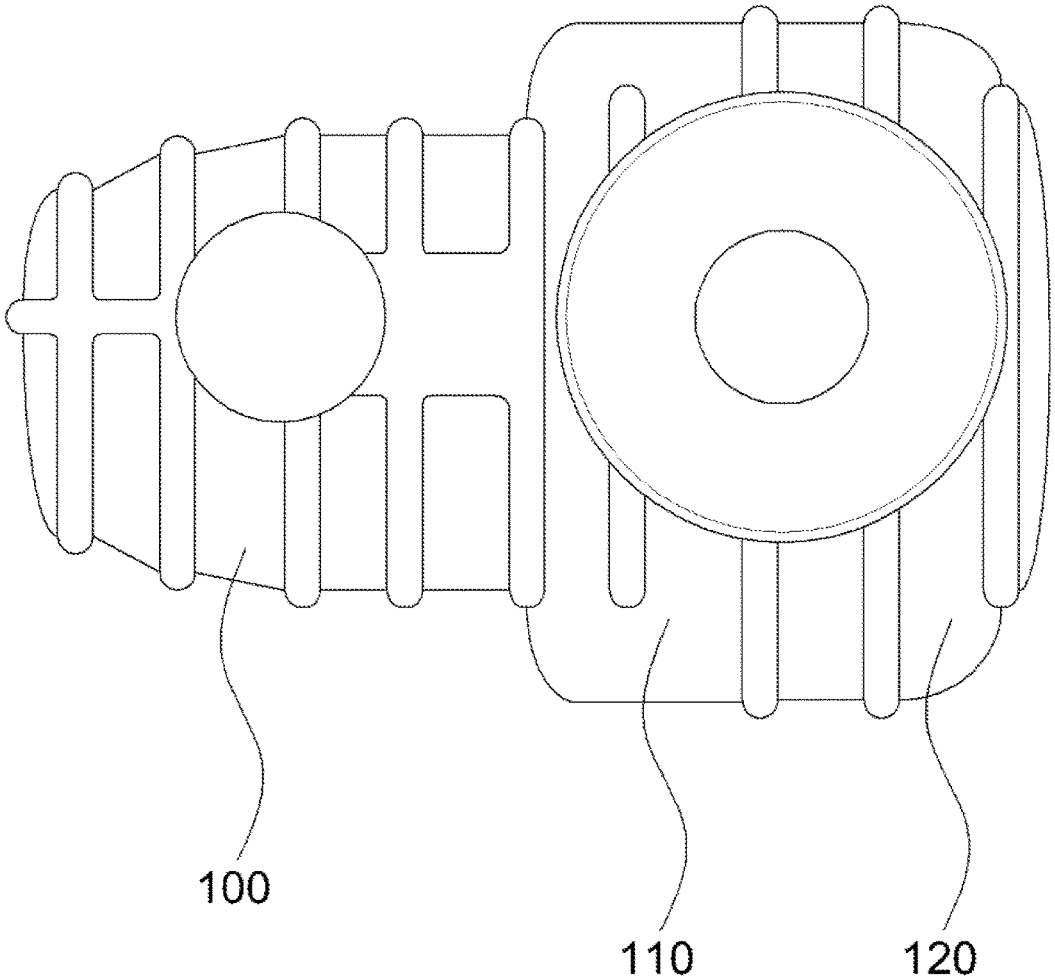
FIG. 10 is an image illustrating an exemplary tractor gearbox comprising an exemplary aluminum alloy according to an exemplary embodiment of the present invention.

In Table 5, the elastic moduli and densities of an alloy with a weight of about 25 kg and an alloy with a weight of about 300 kg according to Comparative Example 3 and Example 1 are compared. In the case of the about 300 kg alloys of Comparative Example 3 and Example 1, a tractor gearbox was divided into three portions, and the elastic modulus and density of each portion thereof were measured as illustrated in FIG. 10.

As a result, in all of Comparative Example 3 and Example 1, the elastic moduli and densities of the about 300 kg alloys were higher than those of the about 25 kg alloys and the elastic moduli and densities of Example 1 were all higher than those of Comparative Example 3.

Accordingly, it can be confirmed that, even when the present invention is applied to a product having a size usable in industrial fields, the present invention may provide superior elastic modulus and density, as being compared to conventional technology.

As is apparent from the above description, the present invention having the composition described above may overcome limitation in elasticity of a hypereutectic Al—Si based alloy and enhance wear properties thereof, etc. through additional reinforcing phase formation such as formation of an $Al_3Ni$ phase generated by nickel (Ni), etc. that may reinforce and enhance properties decreased by a ternary phase, etc. such as TiAlSi through inclusion of titanium (Ti), boron (B), nickel (Ni), etc.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An aluminum alloy comprising:

an amount of 14 to 21% by weight of silicon (Si);

an amount of about 1 to 5% by weight of nickel (Ni);

an amount of about 4 to 5% by weight of titanium (Ti);

an amount of about 0.7 to 1% by weight of boron (B); and aluminum (Al) constituting remaining balance of the aluminum alloy, all the % by weight based on the total weight of the aluminum alloy.

2. The aluminum alloy according to claim 1, wherein an amount of the titanium (Ti) is about 4% by weight and an amount of the boron (B) is about 1% by weight.

3. The aluminum alloy according to claim 1, wherein an amount of the nickel (Ni) is from about 2.3 to about 5% by weight.

4. The aluminum alloy according to claim 3, wherein an amount of the nickel (Ni) is about 5% by weight.

5. A vehicle part comprising an aluminum alloy of claim 1.

6. The vehicle part of claim 5 is a cylinder block, or a cylinder block in an internal combustion engine of a vehicle.

7. An aluminum alloy comprising:

an amount of about 13 to 21% by weight of silicon (Si);

an amount of about 1 to 5% by weight of nickel (Ni);

an amount of about 4 to 5% by weight of titanium (Ti);

an amount of about 0.7 to 1% by weight of boron (B);

an amount of about 4 to 5% by weight of copper (Cu);

an amount of about 0.45 to 0.65% by weight of magnesium (Mg);

an amount of about 1.3% by weight or less of iron (Fe);

an amount of about 0.1% by weight or less of manganese (Mn);

an amount of about 0.1% by weight or less of zinc (Zn); and aluminum (Al) constituting remaining balance of the aluminum alloy, all the % by weight based on the total weight of the aluminum alloy.

8. An aluminum alloy consisting essentially of:

an amount of 14 to 21% by weight of silicon (Si);

an amount of about 1 to 5% by weight of nickel (Ni);

an amount of about 4 to 5% by weight of titanium (Ti);

an amount of about 0.7 to 1% by weight of boron (B); and aluminum (Al) constituting remaining balance of the aluminum alloy, all the % by weight based on the total weight of the aluminum alloy.

9. An aluminum alloy consisting essentially of:

an amount of about 13 to 21% by weight of silicon (Si);

an amount of about 1 to 5% by weight of nickel (Ni);

an amount of about 4 to 5% by weight of titanium (Ti);

an amount of about 0.7 to 1% by weight of boron (B);

an amount of about 4 to 5% by weight of copper (Cu);

an amount of about 0.45 to 0.65% by weight of magnesium (Mg);

an amount of about 1.3% by weight or less of iron (Fe);

an amount of about 0.1% by weight or less of manganese (Mn);

an amount of about 0.1% by weight or less of zinc (Zn), and aluminum (Al) constituting remaining balance of the aluminum alloy, all the % by weight based on the total weight of the aluminum alloy.

* * * * *